United States Patent [19]

Gearhart

[11] 4,144,670

[45] Mar. 20, 1979

[54] CYCLIC-ACTION, SIPHON-OPERATED BUOYANT TOY

[76] Inventor: Walter S. Gearhart, 448 Orlando St., State College, Pa. 16801

[21] Appl. No.: 860,876

[22] Filed: Dec. 15, 1977

[51] Int. Cl.[2] ..... A63H 23/00

[52] U.S. Cl. ..... 46/91; 46/94

[58] Field of Search ..... 46/41, 91, 94

[56] References Cited

U.S. PATENT DOCUMENTS

| | | | |
|---|---|---|---|
| 2,674,065 | 4/1954 | Sprinkle | 46/92 |
| 3,392,483 | 7/1968 | Beatty, Sr. | 46/92 |
| 3,713,250 | 1/1973 | Clough | 46/92 |

*Primary Examiner*—Louis G. Mancene
*Assistant Examiner*—Robert F. Cutting
*Attorney, Agent, or Firm*—Robert F. Custard

[57] ABSTRACT

A cyclic-action buoyant toy has no moving parts. The toy floats in water in a first, horizontal position with a port below water level to admit water into a cavity within the toy, while a siphon connected to a drain operates whenever the toy has admitted enough water to assume a second, angled position. The siphon removes water at a faster rate than the port admits water, restoring the toy to the first position, stopping the siphon, and restarting the cyclic action. One embodiment uses a single-ended siphon, while a faster-acting embodiment uses a dual-ended siphon.

10 Claims, 14 Drawing Figures

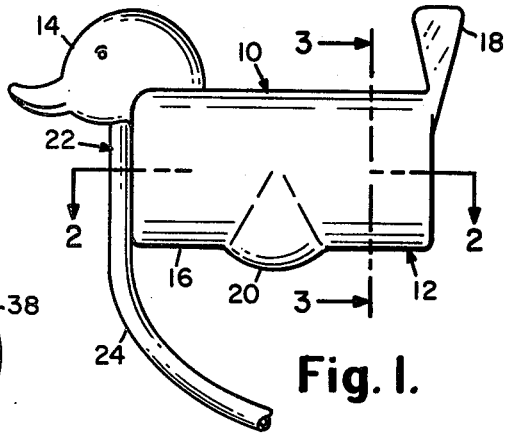
Fig. 1.
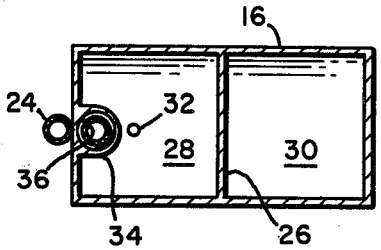
Fig. 2.
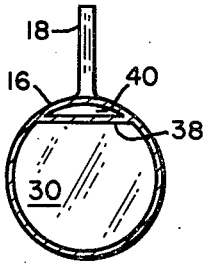
Fig. 3.
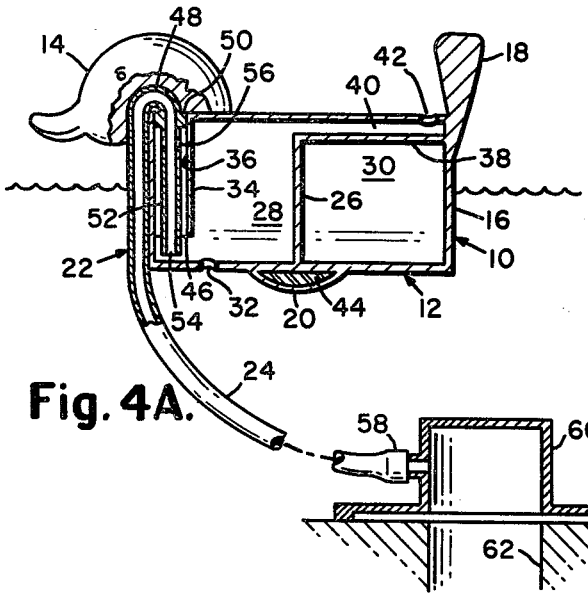
Fig. 4A.
Fig. 4B.
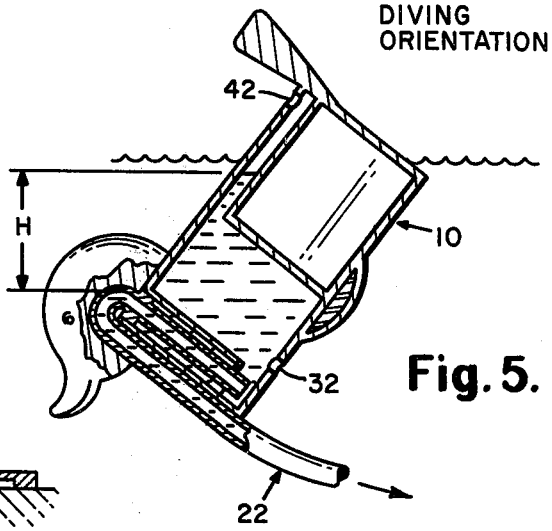
Fig. 5.
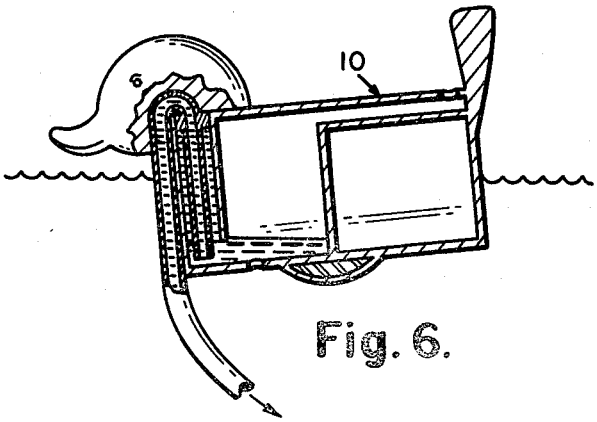
Fig. 6.
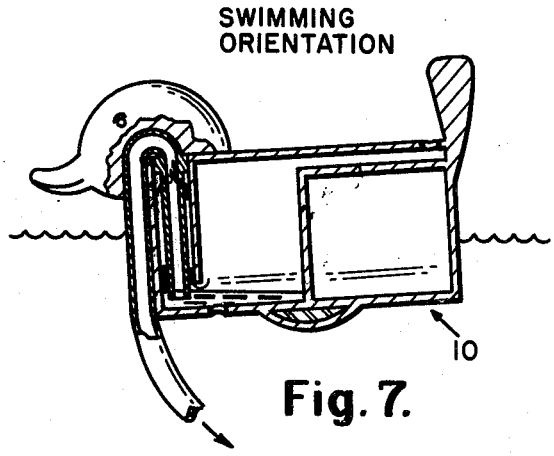
Fig. 7.

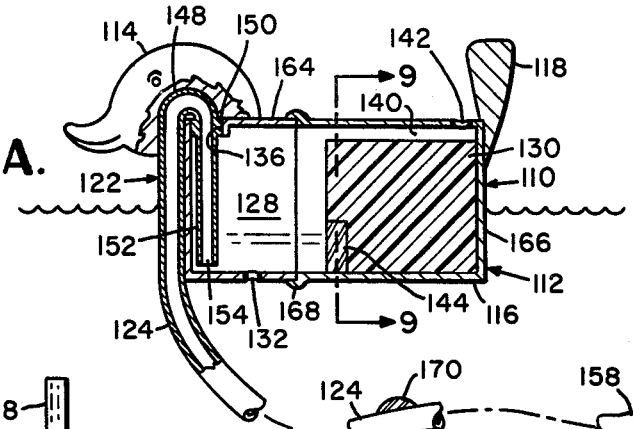
Fig. 8A.
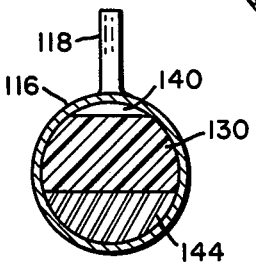
Fig. 9.
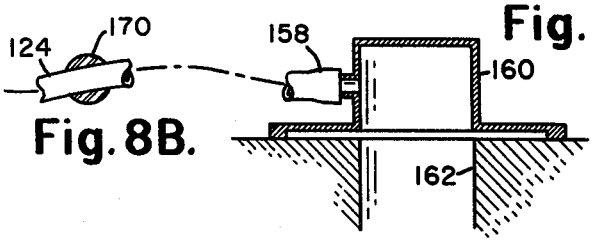
Fig. 8B.
Fig. 8C.
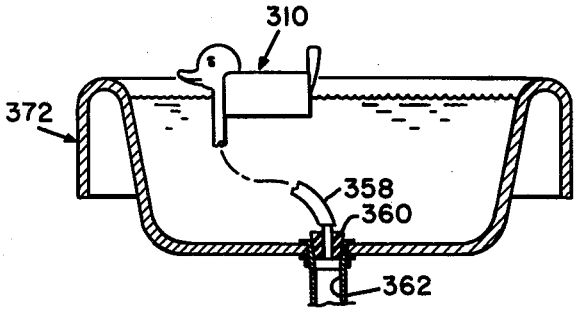
Fig. 11.
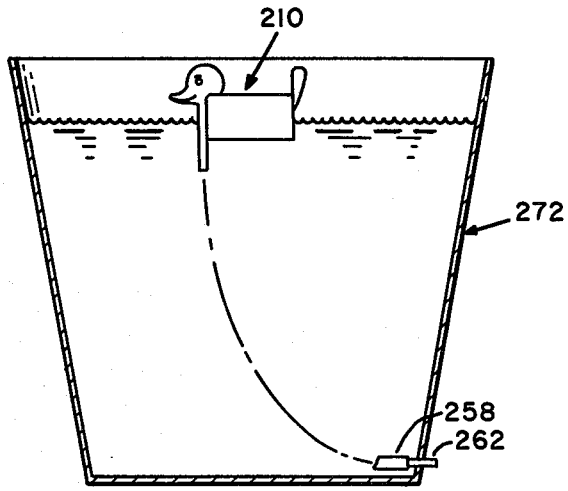
Fig. 10.

CYCLIC-ACTION, SIPHON-OPERATED BUOYANT TOY

BACKGROUND OF THE INVENTION

1. Field of the Invention

The present invention relates to a toy which provides a means of obtaining action while floating in water, without any moving parts, valves, or external controls. The toys includes a cavity with a port below water level to admit water into the toy, unbalancing the initial horizontal floating position, and when a sufficient angle of tilt is reached, a siphon starts, which drains water from this cavity until the water level reaches the point that ends the siphon flow. Since the siphon-drain operates at a rate faster than the water-admitting rate, the toy oscillates between water-empty and water-filled floating positions and is caused to be in constant action.

A specific object of the invention is the provision of a simple, inexpensive, siphon-activated, floating action-toy, which, when shaped as an animal, simulates the normal action of a live animal.

An additional object of the invention is the provision of a completely assembled, one-piece, ruggedized toy with no moving parts to be broken, misaligned, or lost; with no need for gas producing materials or batteries; and adapted to withstand the thoughtless rigors of childhood play.

A further object of one embodiment of the invention is the provision of a siphon-operated action toy with a dual-ended siphon intake configuration which gives a more positive breaking of the drain action at the end of each drain portion of an action cycle, thereby reducing the time between cycles as compared to a single-ended intake configuration and speeding-up the oscillatory action of the toy.

2. Description of the Prior Art

The known prior patents most pertinent to applicant's invention are U.S. Pat. Nos. 2,712,710; 3,010,247; 3,010,251; 3,010,255; 3,036,403; 3,292,303; 3,434,234; 3,588,099; 3,621,604; and 3,739,520, which will be grouped as to structure or operation and discussed below.

U.S. Pat. Nos. 3,010,255 and 3,036,403 disclose buoyant toys which are battery powered, and motor driven; which have floodable buoyancy chambers; and which are much more complex than applicant's ruggedized siphon-operated toys.

U.S. Pat. No. 2,712,710 discloses a cyclic-action buoyant toy which requires the careful filling of a chamber with an effervescent material to provide a controlled, gas-producing action, which stops when the effervescent material has been exhausted. U.S. Pat. No. 3,292,303 discloses a submersible toy which utilizes a manually controllable external weight on a string to produce action. U.S. Pat. No. 3,739,520 discloses a diving toy which requires a continuous supply of pumped air to produce action. U.S. Pat. No. 3,588,099 discloses a Cartesian diving toy which utilizes manual pressure to produce the desired action. Applicant's simplified toys require no effervescent material, no manual pressure, and no pumped air supply to produce continuous action.

U.S. Pat. Nos. 3,010,251 and 3,621,604 disclose devices which require externally operated, remote control bellows or bulb operators to supply action. Applicant's toys require no remote control means.

U.S. Pat. No. 3,010,247 discloses a bathtub toy which produces action by passing the drain water through a water driven motor connected to moving parts of the toy which are active only when a large volume of water is draining through the water motor. Applicant's toys produce continuous action and drain water at a very slow rate through a intermittent siphon.

U.S. Pat. No. 3,434,234 discloses a diving duck toy which produces a simulated live duck diving action by providing a spring motor driven belt with weights mounted on only a selected portion of the belt. Applicant's diving duck toy eliminates the complexities of the spring motor, belt, and the assembly and maintenance problems inherent in a mechanically-driven diving control operator.

SUMMARY

The approach utilized by the applicant has been (1 ) to design ruggedized buoyant toys which can withstand the rigors of childhood play and mistreatment; (2) to simplify both the construction and operation of these toys so that anyone can enjoy them without complex instructions or maintenance; and (3) to produce a product which will gain ready acceptance in the commercial market by overcoming the limitations and complexities of the prior art devices.

The present invention includes a first embodiment having the novel features of a buoyant toy having a water-receiving portion adapted to receive water into the toy, a vent adapted to connect the uppermost part of the water-receiving portion to the ambient atmosphere, and a siphon mounted on the toy with its intake within the water-receiving portion and its discharge through a drain below water level. In one specific embodiment, these novel features are correlated in a duck-shaped toy so that the toy (1) starts in a horizontal position, (2) reaches an angle of tilt sufficient to start the siphon, (3) regains a horizontal position sufficient to stop the siphon, and (4) starts the cycle of (1), (2), (3) again, giving the simulation of the natural live action of a duck diving for food.

An additional embodiment of applicant's invention includes a buoyant toy with a siphon with a dual-ended intake to provide a positive siphon drain termination for each action cycle, which reduces the time for each cycle to approximately one-half of the cycle time for a single-ended siphon, and therefore quickens the action of the toy.

BRIEF DESCRIPTION OF THE DRAWINGS

The objectives of the invention and the manner in which it is carried out will be apparent from the following description and the accompanying drawings, wherein:

FIG. 1 is a side elevational view of a buoyant toy embodying the invention and utilizing a dual-ended siphon intake.

FIG. 2 is a top plan sectional view of the toy of FIG. 1 taken along the line 2—2 thereof.

FIG. 3 is an end elevational sectional view of the toy of FIG. 1 taken along the line 3—3 thereof.

FIG. 4A is a side elevational sectional view of the toy of FIG. 1 with the body thereof broken away along a central cutting plane to show the details of construction and operation. The position of the toy in this view illustrates the initial orientation of the toy immediately after being floated in water. FIG. 4B is a side elevational view of a universal bathtub drain cover adapted to receive the discharge end of the siphon water conduit with portions thereof shown in cross section taken along a central vertical cutting plane.

FIG. 5 is a similar view of the toy of FIG. 4A, but after the water-receiving portion has filled and just after the siphon has started, showing the diving orientation of the toy.

FIG. 6 is a similar view of the toy of FIGS. 4A and 5, but after the siphon has almost drained the water-receiving portion and just before the siphon will stop.

FIG. 7 is a similar view of the toy of FIGS. 4A, 5, and 6, but after the siphon has stopped and the toy is ready to repeat the next cycle, showing the swimming orientation of the toy.

FIG. 8A is a side elevational sectional view of an additional embodiment of buoyant toy with portions broken away along a central vertical cutting plane to show details of construction.

FIG. 8B is a side elevational view of a portion of a siphon water conduit with a weight bead shown in cross section taken along a central vertical cutting plane thereof.

FIG. 8C is a side elevational view of a universal bathtub drain stopper adapted to receive the discharge end of the siphon water conduit, with portions thereof shown in cross section taken along a central vertical cutting plane.

FIG. 9 is an end elevational sectional view of the toy of FIG. 8A taken along the line 9—9 thereof.

FIG. 10 is a central cross-sectional diagrammatic view of a container of water with a simple tube drain adapted to receive the discharge end of a siphon water conduit, with the toy of FIG. 1 or FIG. 8A floating therein.

FIG. 11 is a central cross-sectional diagrammatic view of a wash basin with a stopper adapted to receive the discharge end of a siphon water conduit, with the toy of FIG. 1 or FIG. 8A floating therein.

DESCRIPTION OF THE PREFERRED EMBODIMENTS

Referring to FIG. 1, a cyclic-action buoyant toy 10 is shown. Toy 10 has a housing 12 adapted to float in water. Housing 12 is shaped in the form of a stylized duck with a head 14, a generally cylindrical body 16, a tail 18, and a bulged midsection 20 adapted to confine a crescent-shaped orientation stabilizing mass. Secured to housing 12 is a siphon means 22 which includes a water conduit 24.

Referring to FIG. 2, body 16 has an integrally formed circular partition 26 dividing the interior of body 16 into two portions, a main water-receiving portion or cavity 28 and a buoyant portion 30. Further, within water-receiving portion 28 are a water inlet means or port 32 and an integrally formed tubular projection which forms an intake conduit 34 for siphon means 22. Intake conduit 34 has a uniform cross-sectional area cylindrical bore 36.

Referring to FIG. 3, body 16 has an integrally formed rectangular partition 38 which divides body 16 into buoyant portion 30 and a cylindrical segment 40, which forms a secondary water-receiving portion and connects with main water-receiving portion 28.

Referring to FIG. 4A, body 16 has a vent means or hole 42 therethrough positioned immediately in front of tail 18. Hole 42 connects the ambient atmosphere to main water-receiving portion 28 through cylindrical segment 40. A crescent-shaped stabilizing mass 44 is retained within bulged midsection 20. Siphon means 22 includes intake conduit 34 having an intake end 46 and water conduit 24 which is formed in a 180° turn 48 near one end thereof. Water conduit 24 has an integrally formed enlarged shoulder 50 adjacent turn 48 which mates with and is sealed within bore 36 of body 16. The continuation of water conduit 24 below shoulder 50 forms an intake conduit 52 with an intake end 54. Intake conduit 52 and intake conduit 34 are generally cylindrical, concentric, of uniform cross-sectional area, and are connected near shoulder 50 by flow conduit or holes 56. It will be understood that body 16 is weight stabilized so that the portion of body 16 adjacent to port 32 will always be below water level and the portion of body 16 adjacent to hole 42 will always be above water level when toy 10 is floating in water.

Referring to FIG. 4B, water conduit 24 includes a discharge end 58 connected through a universal drain cover or stopper 60 to a drain 62 which is connected to the ambient atmosphere.

Referring to FIGS. 4A, 4B, 5, 6, and 7, FIG. 4A shows the orientation of toy 10 immediately after being floated in water, but before a substantial amount of water has entered cavity 28. Water continues to enter port 32 until the position of FIG. 5 is reached. FIG. 5 shows the orientation of toy 10 at the point of the greatest angle of dip, which is identified as the diving orientation. When toy 10 attains diving orientation as shown in FIG. 5, water has filled cavity 28 and a portion of segment 40 through port 32 until the water level in segment 40 has reached an elevational distance H above the horizontal tangent to the interior of 180° turn 48 of conduit 24, causing a hydraulic head sufficient to overcome the surface tension and frictional resistances to flow within siphon means 22, thereby starting the flow of water to drain cavity 28 and segment 40. It will be understood that the diameters of port 32 and conduit 24 must be designed so that water will be drained from cavity 28 at a rate substantially faster than water is flowing into cavity 28 through port 32. Water continues to be drained from cavity 28 until toy 10 reaches an orientation as shown in FIG. 6, just before the water level in cavity 28 drops below intake end 46 of intake conduit 34. At the instant that the water level in cavity 28 drops below end 46, the atmospheric pressure will support the cylindrical ring of water between the interior of conduit 34 and the exterior of conduit 52 momentarily, and the lowered pressure within conduit 24 will cause this cylindrical ring of water to be drawn into conduit 24 through flow conduit or holes 56. As soon as the cylindrical ring of water passes through holes 56, the siphon flow is broken and air enters conduit 24 through this cylindrical ring as shown by small arrows in FIG. 7. FIG. 7 is the orientation of toy 10 immediately after the siphon flow is broken, which is identified as the swimming orientation. Water flow through port 32 will now fill cavity 28 until the diving orientation of FIG. 5 is regained and toy 10 will continue to oscillate between these swimming and diving orientations as long as the water is deep enough to float toy 10.

It will be understood that in order for toy 10 to function properly, body 16 and siphon means 22 must be correlated so that, when body 16 is floated in water and discharge end 58 of water conduit 24 is positioned substantially below body 16 and open for unrestricted water flow therefrom or in communication with the ambient atmosphere, water-receiving portion 28 will receive water, and siphon means 22 will intermittently discharge water through discharge end 58 of water conduit 24 at a rate substantially greater than the water flow into water-receiving portion 28 through port 32 so that body 16 will oscillate between swimming and diving orientations.

Referring now to FIGS. 8A, 8B, 8C, and 9, an additional embodiment of applicant's invention is shown. Toy 110 is similar to toy 10 in function and operation, the primary structural differences being the simplification of fabrication techniques, assembly procedures, ballasting means, and buoyancy design; the addition of a ballast or weight bead to conduit 24; and the removal of intake conduit 34 of siphon means 22. The primary operational difference is that the function of intake conduit 34 and holes 56 have been eliminated, leaving only a single intake conduit for the siphon means. Each of the functionally equivalent elements are identified with reference characters that are 100 larger than the equivalent element in the embodiment of toy 10 in FIGS. 1 to 7. Therefore, elements 110, 112, 114, 116, 118, 122, 124, 128, 130, 132, 140, 142, 144, 148, 150, 152, 154, 158, 160, and 162 correspond to the functionally similar elements 10, 12, 14, 16, 18, 22, 24, 28, 30, 32, 40, 42, 44, 48, 50, 52, 54, 58, 60, and 62 in FIGS. 1 to 7, and will be discussed below only where there are significant functional or structural differences.

Referring further to FIGS. 8A, 8B, 8C, and 9, body 116 is formed of two generally cylindrical cup-shaped elements, head element 164 and tail element 166, which are connected by joining lip 168. The function of partitions 26 and 38 which provide a buoyant portion 30 in toy 10, is replaced by a light plastic cylindrical segment 130 which excludes water and provides the desired buoyant force. The function of stabilizing mass 44 is achieved with a heavy cylindrical segment 144 within body 116. The upper flat surface of segment 130 together with the interior of body 116 define a cylindrical segment 140 to serve the function of segment 40 hereinabove. If conduit 124 is formed from a material which gives it a positive buoyancy, one or more weight beads 170 may be frictionally slipped thereon to give conduit 124, together with its beads, a neutral buoyancy or a very slight negative buoyancy in order to eliminate any high points in conduit 124 which would interrupt the automatic cycling of siphon means 122.

The cycling of toy 110, while similar to toy 10, is slightly different and follows the following sequence: (1) water flowing through port 132 fills cavity 128 and segment 140 until a diving orientation identical to FIG. 5 is achieved; (2) siphon means 122 starts to drain cavity 128; (3) water flows through siphon means 122 until a swimming orientation is reached, similar to FIG. 7, but with the water level in cavity 128 just below intake end 154; (4) air enters end 154, and as soon as the cylindrical column of water within intake conduit 152 is drawn past turn 148, siphon means 122 stops draining cavity 128; and (5) the water flowing through port 132 causes toy 110 to repeatedly cycle in endless oscillation between diving and swimming orientations as long as the water is deep enough to float toy 110.

Similarly to toy 10, it will be understood that in order for toy 110 to function properly, body 116 and siphon means 122 must be correlated so that, when body 116 is floated in water and discharge end 158 of water conduit 124 is positioned substantially below body 116 and open for unrestricted water flow therefrom or in communication with the ambient atmosphere, water-receiving portion 128 will receive water, and siphon means 122 will intermittently discharge water through discharge end 158 of water conduit 124 at a rate substantially greater than the water flow into water-receiving portion 128 through port 132 so that body 116 will oscillate between swimming and diving orientations.

Referring now to FIG. 10, a minor variation of assembly and use of applicant's invention is shown. Toy 210 represents either toy 10 or toy 110, described above, floating in a pail or other container 272 of water. Pail 272 has a drain spout 262 adapted to receive discharge end 258 of the water conduit of buoyant toy 210. Toy 210 is constructed and operates in the same manner as toy 10 or toy 110; however, the simplicity of design of drain spout 262 eliminates the need for a drain cover or stopper. Further, it will be understood that an application of applicant's invention as shown in FIG. 10 will operate when pail 272 is placed in a larger body of water, for instance, a child's swimming pool, as long as the level of water toy 210 floats in is substantially higher than the water level of the larger body of water.

Referring now to FIG. 11, an additional variation of assembly and use of applicant's invention is shown. Toy 310 represents either toy 10 or toy 110, described above, floating in a basin 372. Basin 372 has a drain 362 adapted to receive a drain stopper 360, which is adapted to connect to discharge end 358 of the water conduit of buoyant toy 310.

The construction and operation of toys 210 and 310 are the same as toys 10 and 110.

While the general construction and operation of applicant's invention have been discussed above, additional details of construction and fabrication will be set forth below. A model of the toy 10 disclosed in FIGS. 1 to 7 has been built with a body 16 approximately 2 inches in diameter and 4 inches long. Water conduit 24 is 3/16 inch I.D. and ¼ inch O.D. latex surgical tubing. Inlet port 32 is 5/64 inch diameter and vent hole 42 is ¼ inch diameter. Intake conduit 52 is the same diameter as conduit 24, and intake conduit 34 is ⅜ inch I.D. and 17/32 inch O.D. Intake end 54 extends ¼ inch below intake end 46. There are two holes 56 which are 1/16 inch diameter. Body 16, head 14, and tail 18 are formed of polyvinyl chloride with body 16 and tail 18 cast integrally and head 14 cemented thereupon. It will be understood that any of body 16, head 14, and tail 18 could be cast separately and assembled later. Shoulder 50 is cemented into bore 36. Mass 44 is brass, but might be lead or other heavy material. Stopper 60 is a conventional universal bathtub stopper, commercially available, but provided with an integral cylindrical connector to form a slip fit with discharge end 58. Conduit 24 is latex surgical tubing, but could be formed of any other flexible material used for water carrying tubing. The toy 10, sized and formed as described above, cycles approximately once every 35 seconds.

A model of the toy 110 disclosed in FIGS. 8A, 8B, 8C, and 9 has been built to have the same construction and dimensions as the toy 10 described above, but with the following changes: (1) intake conduit 34 is eliminated, (2) holes 56 are eliminated, (3) port 132 is approximately 5/128 inch diameter, (4) buoyant portion 130 is styrofoam, (5) mass 144 is positioned within body 116, (6) body 116 is formed in two halves which are cemented together, and (7) a weight bead 170 of glass or brass is provided. In this embodiment the port 132 must be smaller than port 32 if the other dimensions remain the same so that the water flow through siphon means 122 will stop; otherwise, a flow of a mixture of water and air might continue to flow and interfere with the desired cyclic action. In this embodiment, head 114 and tail 118 have both been formed separately and cemented to body 116. The toy 110, sized and formed as described above, cycles approximately once every minute.

Since the embodiment of applicant's invention shown as toy 10 cycles faster than the embodiment shown as toy 110, it is preferred for the applications shown; however, other embodiments of applicant's invention with a slower cycle rate and the advantages of the simpler siphon means 122 may be preferred for other forms of applicant's invention. While the embodiments of applicant's invention shown in FIGS. 1 to 11 show a generally cylindrical body together with a stylized duck motif, the invention is applicable to any other shape of body which is buoyant; obvious other shapes include those of the hippopotamus, turtle, whale, submarine, porpoise, or human figure. Other variations would include forming shoulder 50 or 150 of a separate ring of material friction fitted over or cemented to conduit 24 or 124. While ports 32 and 132 have been shown to be cylindrical holes, they could be any shape or form which will admit water at the desired rate, including water permeable materials, such as preformed metal or plastic porous plugs inserted in openings in bodies 16 and 116, respectively. While vent means 42 and 142 have been shown to be cylindrical holes, they could have any shape or form which will transmit air, including air permeable materials, such as preformed metal or plastic porous plugs inserted in openings in bodies 16 and 116, respectively. Body 16 or 116 including head 14 or 114 and tail 18 or 118 could be molded in two halves and cemented or otherwise joined together along a central parting plane. In addition, the housings or bodies envisioned could include any of the materials and fabrication techniques utilized to fashion childrens toys of either the sandbox or water buoyant type, including rubber, metals, and flexible, rigid, and semi-rigid plastics.

Further, if the body and siphon means of the toy are made of clear or translucent plastics, additional educational and amusement dimensions are added, since (1) the starting and stopping of the siphon action, and (2) the filling and draining action within the toy can be observed and understood. Applicant's toys may be dramatically utilized in aquariums, either lighted or unlighted; and if they are at least partially transparent or translucent, every element of the filling, siphon starting, draining, and siphon stopping actions may be clearly observed.

Further, it will be understood that stoppers 60 and 160 may have any number of hollow adapter projections so that a multiplicity of toys 10 and 110 may be operated at one time in the same body of water. It will be understood that these stoppers may be provided with either small plastic plugs or caps to close the adapters when not being used with applicant's toys, so that the stopper may function in a conventional manner.

Further, while the dual-ended embodiment of toy 10 has been illustrated with concentric intake conduits, these two conduits could be side by side, or one eccentrically within the other. A convenient form would be a single cylindrical tube with a wall dividing the tube into two half-cylindrical conduits. The only functional requirement being that the two conduits must be merged or connected to provide a common flow at a point remote from the ends of both conduits.

Further, the stabilizing function of mass 44 or 144 could be provided by casting particulate or preformed weighting material within the toy body itself or by casting the body of the toy to be substantially heavier at the bottom central portion. Further, styrofoam buoyant portion 130 could be functionally replaced by a thin-walled, cheaply-cast, sealed hollow capsule to provide the equivalent buoyancy.

Further, although applicant has illustrated only toys which oscillate at the surface of water, other embodiments are envisioned which may submerge and resurface. However, since a vent means must always be provided in communication with the ambient atmosphere, in embodiments which submerge, it would be necessary to provide a projection, for instance, a tail on an animal, or a conning tower on a submarine, or a float safety on a skin diver, through which a vent passage to the atmosphere would always be available, or to provide a floating vent with a connecting flexible conduit to the vent hole in the body.

Further, although applicant has illustrated only toys which oscillate in a dipping action, toys which oscillate from side to side, or from angled to horizontal positions are envisioned. By providing two separate cavities, two separate siphon means, and a proper body configuration, it would be obvious to provide a toy that oscillated from side to side and dipped from front to back at the same time.

In view of the disclosed invention set forth above, other variations and modifications will become evident to others skilled in the art to obtain all or part of the benefits of this invention without copying the structures shown, and therefore all such variations are claimed insofar as they fall within the reasonable spirit and scope of the claims set forth hereinbelow.

Having thus described the invention, what is claimed as new and desired to be secured by Letters Patent is:

1. A cyclic-action buoyant toy comprising:

a body, said body adapted to float in at least two predetermined orientations in water said body including, a water-receiving portion, a water inlet means, said water inlet means adapted to permit water flow into said water-receiving portion when said body is floated in water, and a vent means, said vent means adapted to provide a water-free conduit between said water-receiving portion and the ambient atmosphere;

a siphon means connected to said body, said siphon means including, a water conduit, said water conduit including an intake end and a discharge end; and said body and said siphon means so correlated that when said body is floated in water and said discharge end of said water conduit is positioned substantially below said body and open for unrestricted water flow therefrom, said water-receiving portion will receive water, and said siphon means will intermittently discharge water through said discharge end of said water conduit at a rate substantially greater than said water flow into said water-receiving portion, whereby said body is adapted to oscillate between said two predetermined orientations.

2. The combination of claim 1, wherein said intake end of said water conduit includes:

a first intake conduit with a first intake end, a second intake conduit with a second intake end, and a flow conduit connecting said first intake conduit and said second intake conduit, said flow conduit substantially removed from both said first intake end and said second intake end.

3. The combination of claim 2, wherein:

said first intake conduit has a substantially uniform cross-sectional area, and said second intake conduit has a substantially uniform cross-sectional area that is substantially larger than said cross-sectional area of said first intake conduit.

4. The combination of claim 2, wherein, whenever said housing is floated in water:

both said first intake conduit and said second intake conduit are oriented generally vertically, and said first intake end extends substantially below said second intake end.

5. The combination of claim 4, wherein:

said first intake conduit has a substantially uniform cross-sectional area, and said second intake conduit has a substantially uniform cross-sectional area that is substantially larger than said cross-sectional area of said first intake conduit.

6. A cyclic-action buoyant toy for use in a bathtub or the like comprising:

a body, said body adapted to float in at least two predetermined orientations in water, said body being weight stabilized so that a first portion will always be below water level when said body is floated in water, and a second portion will always be above water level when said body is floated in water, said body including, a water-receiving portion, a water inlet means located in said first portion, said water inlet means adapted to permit water flow into said water-receiving portion when said body is floated in water, and a vent means located in said second portion, said vent means adapted to provide a water-free conduit between said water-receiving portion and the ambient atmosphere; and a siphon means connected to said body, said siphon means including, a water conduit, said water conduit including an intake end and a discharge end; and said body and said siphon means so correlated that when said housing is floated in water and said discharge end of said water conduit is positioned substantially below said body and open for unrestricted water flow therefrom, said water-receiving portion will receive water, and said siphon means will intermittently discharge water through said discharge end of said water conduit at a rate substantially greater than said water flow into said water-receiving portion, whereby said body is adapted to oscillate between said two predetermined orientations.

7. The combination of claim 6, wherein said intake end of said water conduit includes:

a first intake conduit with a first intake end, a second intake conduit with a second intake end, and a flow conduit connecting said first intake conduit and said second intake conduit, said flow conduit substantially removed from both said first intake end and said second intake end.

8. The combination of claim 7, wherein:

said first intake conduit has a substantially uniform cross-sectional area, and said second intake conduit has a substantially uniform cross-sectional area that is substantially larger than said cross-sectional area of said first intake conduit.

9. The combination of claim 7, wherein, whenever said housing is floated in water:

both said first intake conduit and said second intake conduit are oriented generally vertically, and said first intake end extends substantially below said second intake end.

10. The combination of claim 9, wherein:

said first intake conduit has a substantially uniform cross-sectional area, and said second intake conduit has a substantially uniform cross-sectional area that is substantially larger than said cross-sectional area of said first intake conduit.

* * * * *